US005508789A

United States Patent [19]

Castelli et al.

[11] Patent Number: 5,508,789

[45] Date of Patent: Apr. 16, 1996

[54] APPARATUS AND METHOD TO CONTROL AND CALIBRATE DELIBERATE SPEED MISMATCH IN COLOR IOTS

[75] Inventors: Vittorio Castelli, Yorktown Heights; Joannes N. M. deJong, Suffern; Lloyd Williams, Mahopac, all of N.Y.

[73] Assignee: Xerox Corporation, Stamford, Conn.

[21] Appl. No.: 343,816

[22] Filed: Nov. 22, 1994

[51] Int. Cl.[6] ..... G03G 15/00

[52] U.S. Cl. ..... 355/208; 318/85; 355/200; 355/271

[58] Field of Search ..... 355/200, 203, 355/271, 317, 327; 347/115, 116, 139, 153; 101/245; 318/85, 66, 69, 70, 71, 48, 52

[56] References Cited

U.S. PATENT DOCUMENTS

| | | | |
|---|---|---|---|
| 3,944,896 | 3/1976 | Rodek | 318/85 |
| 4,017,065 | 4/1977 | Poehlein | 271/80 |
| 4,017,067 | 4/1977 | Soures et al. | 271/80 |
| 4,951,095 | 8/1990 | Warden | 355/273 |
| 5,160,946 | 11/1992 | Hwang | 346/157 |
| 5,166,735 | 11/1992 | Malachowski | 355/282 |
| 5,313,252 | 5/1994 | Castelli et al. | 355/203 |

FOREIGN PATENT DOCUMENTS

| | | | |
|---|---|---|---|
| 4-204459 | 7/1992 | Japan | 355/200 |

*Primary Examiner*—Joan H. Pendegrass
*Attorney, Agent, or Firm*—Kevin R. Kepner

[57] ABSTRACT

A method and apparatus for controlling speed match between a photoreceptor and an intermediate transfer member to prevent image degradation by creating a deliberate speed mismatch. It has been found that slight variations in speed match between a photoreceptor and transfer member will maintain acceptable image quality, however, should the relative velocity between the members change sign, unacceptable image error results. The method herein comprises slewing the velocity of a photoreceptive member over a range of speeds while monitoring the output control signal current of a drive motor. The resulting control signal current has a large oscillation at the velocity at which the speed of the photoreceptor matches that of the intermediate transfer member. A controller is then used to maintain the motor velocity at a speed slightly less than or slightly greater than the intermediate transfer member speed so as to prevent a change in sign of the relative velocity between the two moving surfaces.

21 Claims, 4 Drawing Sheets

APPARATUS AND METHOD TO CONTROL AND CALIBRATE DELIBERATE SPEED MISMATCH IN COLOR IOTS

This invention relates generally to an apparatus and method to control the speed match of driven components in electrophotographic printing machines, and more particularly concerns a device and method to control and calibrate the speed match between a photoreceptor and intermediate transfer member in multiple print engine devices particularly those utilizing an intermediate transfer system.

In a typical electrophotographic printing process, a photoconductive member is charged to a substantially uniform potential so as to sensitize the surface thereof. The charged portion of the photoconductive member is exposed to a light image to selectively dissipate the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering electrostatically to carrier granules. The toner particles are attracted from the carrier granules to the latent image forming a toner powder image on the photoconductive member. The toner powder image is then transferred from the photoconductive member to a copy sheet by "tack" transfer: i.e., the copy sheet is attached to the photoreceptor with a sufficiently high force to overcome external forces that might otherwise tend to cause slip. The toner particles are heated to permanently affix the powder image to the copy sheet.

The foregoing generally describes a typical black and white electrophotographic printing machine. With the advent of multicolor electrophotography, it is desirable to use the so-called tandem architecture which comprises a plurality of image forming stations. This tandem architecture offers potential for high throughput and image quality. One choice of photoreceptors in this tandem engine architecture is a drum based photoreceptor architecture used in combination with an intermediate transfer medium. Belt type photoreceptors can also be used in combination with either an intermediate transfer belt or an intermediate transfer drum. In these tandem architectures the motions of the photoreceptors and of the intermediate medium are usually independently controlled and differences in radii due due conicity, out-of-round or wobble cause relative motion to occur in the transfer zone.

In any of the above mentioned configurations, when images are transferred from the photoreceptor to the intermediate medium by slip transfer, excessive velocity mismatch will result in image smear and a consequential degradation in image quality. Moreover, a changing in sign of the relative velocities as a result of crossover between positive and negative slip between a photoreceptor and intermediate member will result in the friction force between the photoreceptor and the intermediate medium to undergo large changes due to the changing of its sign. The large changes in force cause motion disturbances which result in excessive image degradation. It is desirable to provide an apparatus and method for maintaining a relative velocity within specified parameters so that excessive image smear will not result. Furthermore, it is desirable to have a method to calibrate the speed of components such as photoreceptor drums and/or intermediate belts so that errors in velocity due to eccentricity, wobble and other manufacturing defects do not cause the direction of slip to change while in operation.

The following disclosures may be relevant to various aspects of the present invention:

U.S. Pat. No. 5,313,252
Inventor: Castelli et al.
Issue Date: May 17, 1994
U.S. Pat. No. 5,166,735
Inventor: Malachowski
Issue Date: Nov. 24, 1992
U.S. Pat. No. 5,160,946
Inventor: Hwang
Issue Date: Nov. 3, 1992
U.S. Pat. No. 4,951,095
Inventor: Warden
Issue Date: Aug. 21, 1990
U.S. Pat. No. 4,017,067
Inventor: Soures, et al.
Issuer Date: Apr. 12, 1977
U.S. Pat. No. 4,017,065
Inventor: Poehlein
Issuer Date: Apr. 12, 1977

The relevant portions of the foregoing disclosures may be briefly summarized as follows:

U.S. Pat. No. 5,313,252 to Castelli describes an apparatus and method for detecting and reducing image transfer smear. A pattern consisting of a sequence of toner characters or marks separated by spaces is written and developed on a photoreceptive member and then transferred to an intermediate medium. As the pattern is transferred to the intermediate medium, the velocity of the photoreceptor is varied. A photodetector is used to detect the transferred pattern on the intermediate medium and generate a signal indicative thereof. As the detector senses the absence of toner, the signal generated is greater when the space between the toner characters is largest. By monitoring when the signal is greatest and determining the corresponding velocity of the photoreceptor at that time, the best velocity match between the photoreceptor and intermediate transfer medium can be determined and set.

U.S. Pat. No. 5,166,735 to Malachowski discloses a sheet transport system incorporating a control for matching drive speeds imparted to a sheet extending between adjacent workstations. A copy sheet is engaged by a receiving surface disposed between the workstations and is adhered to the receiving surface by vacuum. The copy sheet follows a path offset from a linear path extending between the workstations. Fuser rolls are driven at a slightly higher speed to tension the copy sheet and lift it from the transport surface, the lifting is then detected by a sensor for sensing the vacuum in a plenum communicated with the receiving surface and the drive speed of the fuser rolls is controlled in accordance with the signal from the sensor.

U.S. Pat. No. 5,160,946 to Hwang discloses a registration system for an electrophotographic printing machine which forms registration indicia at a first transfer station and utilizes the formed indicia to register the image at subsequent transfer stations.

U.S. Pat. No. 4,951,095 to Warden discloses a xerographic copy machine having a circulating endless belt photoreceptor. A sheet is fed to the transfer region by a pair of coating rolls driven by a variable speed step motor. The rolls feed the leading portion of the copy sheet at approximately the same speed as the photoreceptor and when the copy sheet contacts the photoreceptor, the feed rolls are driven at a faster speed for a short interval to generate a buckle in a copy sheet just before the transfer region. The speed of the feed rolls is then returned to the initial value so that the buckle size remains constant while the remainder of the sheet is fed. The buckle provides sufficient surplus in the copy sheet to prevent it being pulled taught in the transfer region and thereby smearing the unfused toner image.

U.S. Pat. No. 4,017,067 to Soures, et al. describes an electrostatographic copier wherein the fuser rolls are positioned closer than the dimensions of the copy sheet from the image transfer area. Speed mismatch compensation between the fuser roll nip and the transfer region is provided by intentionally driving the fuser roll nip at a different preset velocity to form a buckle in the intermediate portion of the copy sheet, the buckle being controlled by selective cyclic reductions in the vacuum applied to a vacuum changer sheet guide surface between the fuser nip and the transfers area.

U.S. Pat. No. 4,017,065 to Poehlein describes an electrostatographic copier, wherein the fuser rolls are positioned closer than the dimensions of the copy sheet from the image transfer area. Speed mismatch compensation between the fuser roll nip and the image transfer area is provided by intentionally driving the fuser roll at a different velocity to form a buckle in the intermediate portion of the copy sheet, the buckle controlled by selective cyclic reductions in the vacuum applied to a configured manifold guide surface. The guide surface may be divided into segments through one of which the vacuum is continuously maintained.

In accordance with one aspect of the present invention, there is provided a method of controlling the relative velocity between an image bearing member and an image receiving member of a printing machine. The method comprises determining the relative velocity between the image bearing member and the image receiving member and adjusting the relative speed of between the image bearing member and the image receiving member so that there is a velocity mismatch within a preselected range therebetween.

Pursuant to another aspect of the present invention, there is provided a method for maintaining the proper relative velocity between a photoreceptor and an intermediate receiving member in an electrophotographic printing machine. The method comprises determining the relative velocity between the photoreceptor and the intermediate receiving member and adjusting the speed of the photoreceptor so that there is a slight velocity mismatch between the photoreceptor and the intermediate receiving member.

Pursuant to yet another aspect of the present invention, there is provided a printing machine having an image bearing member and a moving image receiving member. The apparatus comprises a motor for moving the image bearing member and a controller associated with the motor, for regulating the motor to move the image bearing member at a velocity either slightly greater than or slightly less than a velocity at which the image receiving member moves.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 3:
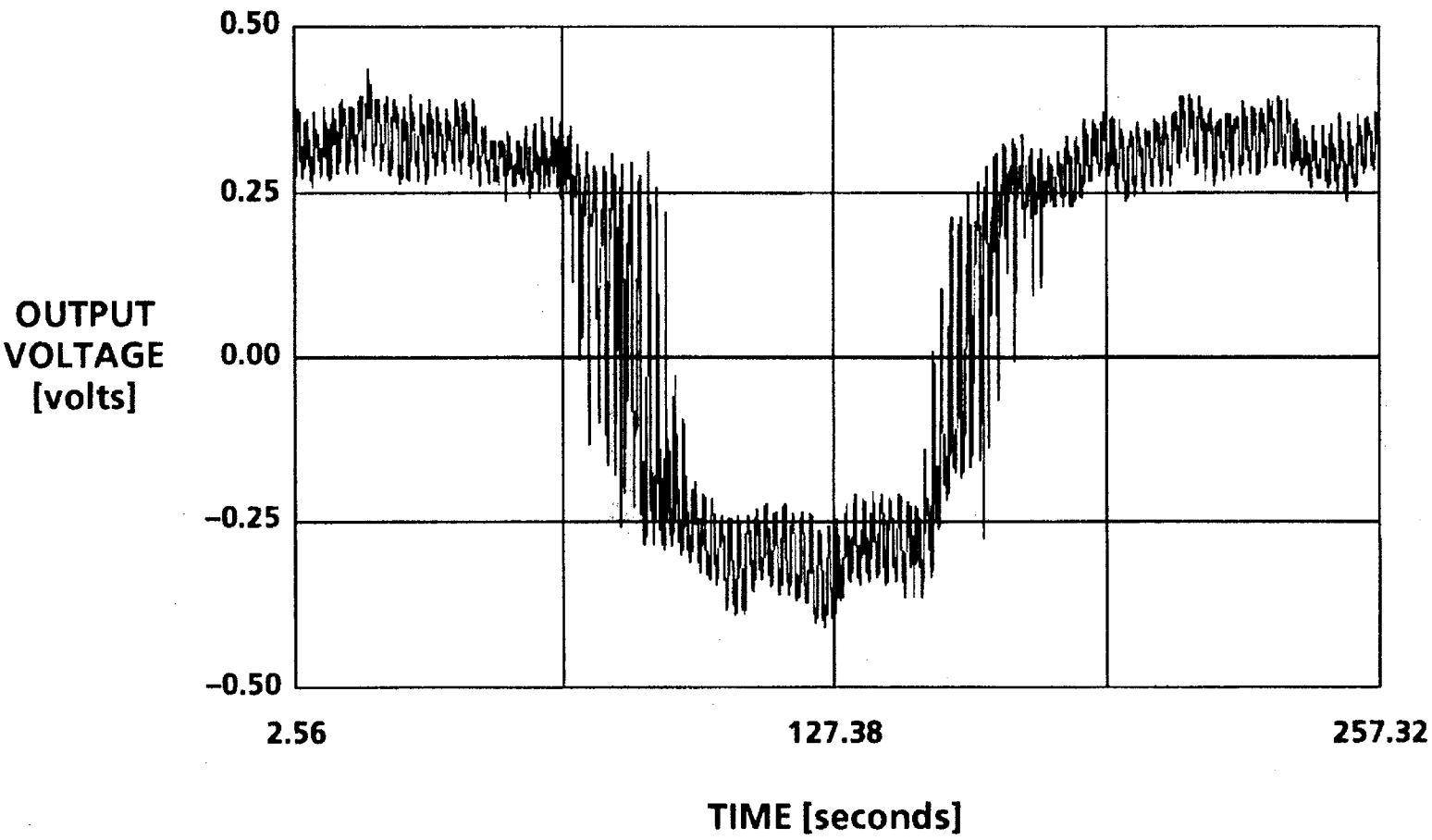
FIG. 3 is a graphical illustration of a drive amplifier command signal corresponding to the velocity slewing of FIG. 2.
Figure 4:
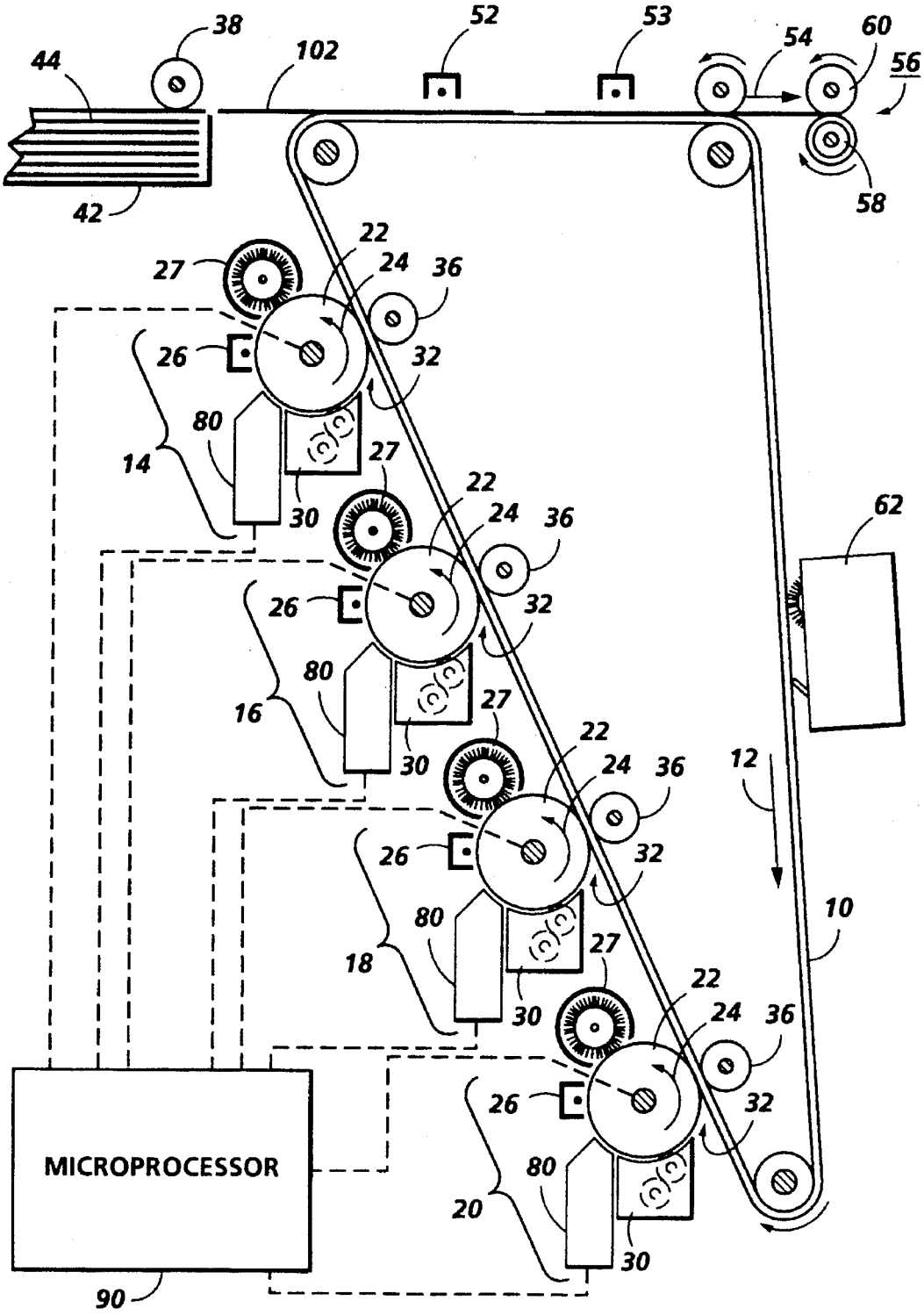
FIG. 4 is a schematic elevational illustration of a multicolor electrophotographic printing machine utilizing the present invention therein.

For a general understanding of the features of the present invention references are made to the drawings. In the drawings, like reference numerals have been used throughout to designate identical elements. Referring now to FIG. 4 3, an intermediate belt designated generally by the reference numeral 10 is mounted rotatably on the machine frame. Belt 10 rotates in the direction of arrow 12. Four imaging reproducing stations indicated generally by the reference numerals 14, 16, 18 and 20 are positioned about the periphery of the belt 10. Each image reproducing station is substantially identical to one another. The only distinctions between the image reproducing stations is their position and the color of the developer material employed therein. For example, image reproducing station 14 uses a black developer material, while stations 16, 18 and 20 use yellow, magenta and cyan colored developer material. Inasmuch as stations 14, 16, 18 and 20 are similar, only station 20 will be described in detail.

At station 20, a drum 22 having a photoconductive surface deposited on a conductive substrate rotates in direction of arrow 24. Preferably, the photoconductive surface is made from a selenium alloy with the conductive substrate being made from an electronically grounded aluminum alloy. Other suitable photoconductive surfaces and conductive substrates may also be employed. Drum 22 rotates in the direction of arrow 24 to advance successive portions of the photoconductive surface through the various processing stations disposed about the path of movement thereof.

Initially, a portion of the photoconductive surface of drum 22 passes beneath a corona generating device 26. Corona generating device 26 charges the photoconductive surface of the drum 22 to a relatively high, substantially uniform potential.

Next, the charged portion of the photoconductive surface is advanced through the imaging station. At the imaging station, an imaging unit indicated generally by the reference numeral 80, records an electrostatic latent image on the photoconductive surface of the drum 22. The imaging stations 80 may be any type of raster input/output scanning device (RIS/ROS). A RIS device typically has document illumination lamps, optics, a scanning drive, and photosensing elements, such as a CCD array, i.e. a charge coupled device. A RIS device scans an original document one line at a time generating electrical raster image signals representative of a particular color component in the original document. The RIS captures the image from the original document and converts the image to a series of raster scan lines which are transmitted as electrical signals to an image processing system (IPS) which may be a portion of controller 90 which is preferably, a self-contained, dedicated minicomputer.

The IPS generates electrical signals according to a prescribed scheme from the raster image signals representative of the original document. The conventional circuitry of the IPS is well known to one skilled in the art. A user interface (UI) will generally be in communication with the IPS to enable an operator to control the various operator adjustable functions. A ROS generates a raster image of the original document in response to the electrical signals from the IPS. The raster output scanner lays out the electrostatic latent image in a series of horizontal scan lines with each line having a specified number of pixels per inch. Preferably, the raster output scanner employs a laser which generates a modulated beam of light rays which are scanned across the drum 22 by rotating a polygon mirror.

It should be understood the imaging stations 80 are not limited to RIS/ROS combinations. For instance, a ROS could be interfaced with a microprocessor in which data can be inputted therein by use of a keyboard terminal. The microprocessor would then generate an electrical signal representative of the inputted data. The ROS, responsive to the electrical signals of the microprocessor, would then generate a raster image, representative of the data stored in the microprocessor, to record an electrostatic latent image on a selected one of the photoreceptors 22. Alternatively, the raster output scanner may use light emitting diode array write bars. In this way, an electrostatic latent image is recorded on the photoconductive surface of the drum 22.

Next, a developer unit indicated generally by the reference numeral 30 develops the electrostatic latent image with a cyan colored developer material. Image reproducing stations 14, 16 and 18 use black, yellow and magenta colored developer materials respectively. The latent image attracts toner particles from the carrier granules of the developer material to form a toner powder image on the photoconductive surface of drum 22. After development of the latent image with cyan toner, drum 22 continues to move in direction of arrow 24 to advance the cyan toner image to a transfer zone 32 where the cyan toner image is transferred from drum 22 to intermediate belt 10 by an intermediate transfer device such as a biased transfer roll 36.

At transfer zone 32, the developed powder image is transferred from photoconductive drum 22 to intermediate belt 10. Belt 10 and drum 22 have substantially the same tangential velocity in the transfer zone 32. Belt 10 is electrically biased to a potential of sufficient magnitude and polarity by biased transfer roll 36 to attract the developed powder image thereto from drum 22. Preferably, belt 10 is made from a conductive substrate with an appropriate dielectric coating such as a metallized polyester film.

After the cyan toner image is transferred to the belt 10 at reproducing station 20, belt 10 advances the cyan toner image to the transfer zone of reproducing station 18 where a magenta toner image is transferred to belt 10, in superimposed registration with the cyan toner image previously transferred to belt 10. After the magenta toner image is transferred to belt 10, belt 10 advances the transferred toner images to reproducing station 16 where the yellow toner image is transferred to belt 10 in superimposed registration with the previously transferred toner images. Finally, belt 10 advances the transferred toner images to reproducing station 14 where the black toner image is transferred thereto in superimposed registration with the previously transferred toner images. After all of the toner images have been transferred to belt 10 in superimposed registration with one another to form a multicolor toner image, the multicolor toner image is transferred to a sheet of support material, e.g., a copy paper at the transfer station.

At the transfer station, a copy sheet is moved into contact with the multicolor toner image on belt 10. The copy sheet 102 is advanced to transfer station from a stack of sheets 44 mounted on a tray 42 by a sheet feeder 38. The copy sheet 102 is advanced into contact with the multicolor image on belt 10 beneath corona generating unit 52 at the transfer station. Corona generating unit 52 sprays ions on to the back side of the sheet to attract the multicolor image to the front side thereof from belt 10. After transfer, the copy sheet passes under a second corona generating unit 53 for detack and continues to move in the direction of arrow 54 to a fusing station. The fusing station includes a fuser assembly generally indicated by the reference numeral 56, which permanently affixes the transferred toner image to the copy sheet. Preferably, fuser assembly 56 includes a heated fuser roll 58 and a backup roller 60 with the toner image on the copy sheet contacting fuser roller 58. In this manner, the toner image is permanently affixed to the copy sheet. After fusing, the copy sheets are then fed either to an output tray (not shown) or to a finishing station (not shown), which may include a stapler or binding mechanism.

Referring once again to reproducing station 20, invariably, after the toner image is transferred from drum 22 to belt 10, some residual particles remain adhering thereto. These residual particles are removed from the drum surface 22 at the cleaning station 27. Cleaning station includes a rotatably mounted fibrous or electrostatic brush in contact with the photoconductive surface of drum 22. The particles are cleaned from the drum 22 by rotation of the brush in contact therewith.

After the print sheet is separated from surface of belt 10, the residual toner/developer and paper fiber particles adhering to the surface are removed therefrom at cleaning station 60. Cleaning station 62 includes a rotatably mounted fibrous brush in contact with belt surface to disturb and remove paper fibers and a cleaning blade to remove the nontransferred toner particles. The blade may be configured in either a wiper or doctor position depending on the application.

The various machine functions are regulated by controller 90. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

It is believed that the foregoing description is sufficient for the purposes of the present application to illustrate the general operation of a tandem printing machine.

Slip transfer is a term which indicates that relative motion may exist between the image carrier and the image recipient in the contact area within which transfer occurs. This usually implies that the mating elements (a photoreceptor, intermediate transfer medium, or a sheet) are independently driven. In a tandem printing machine, this technique is employed to obviate the effects on registration of size mismatch between the various photoreceptors in terms of their barrel convexities, conicities and radii. One way in which to measure image distortions as well as relative registration in multi-color or monochromatic image output terminals (IOT), is to print special marks which are automatically interpreted. Machine architectures that utilize an intermediate transfer medium can employ a marks-on-belt detector, which consists of optics, photodetectors and the requisite circuitry to process the signals. The marks-on-belt detector can measure characteristics of marks placed on the photoreceptor or image receiving medium that reveal information regarding the motion of the photoreceptors relative to the intermediate medium. The intermediate medium can be an intermediate transfer belt or can be any image receiving medium in a printing machine including a copy sheet or other substrate. The invention herein will be described using an intermediate transfer belt as the example.

Figure 1:
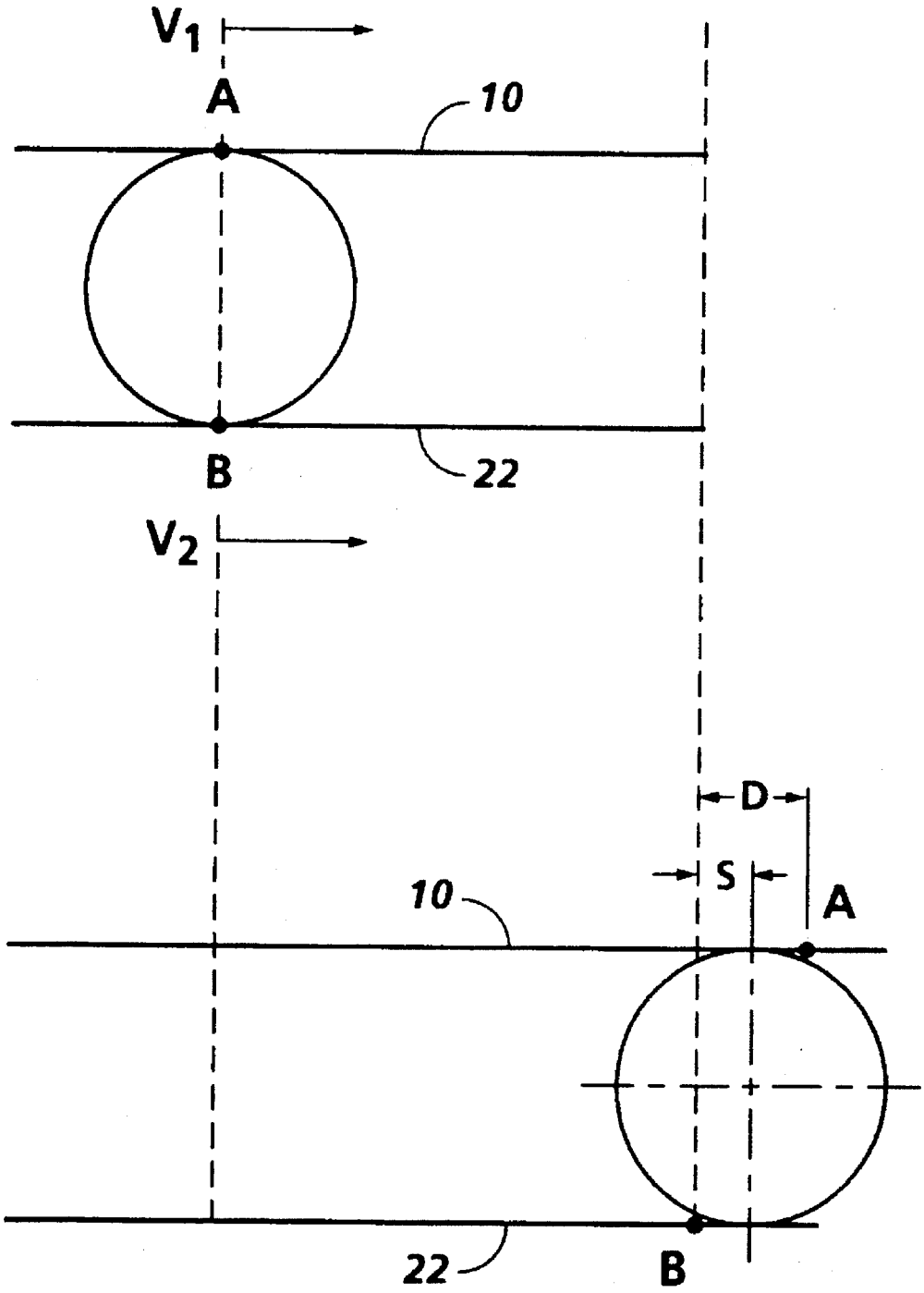
FIG. 1 is a schematic illustration of a single particle being transferred from one moving medium to another moving medium.

When the speed of the photoreceptor differs from the speed of the intermediate belt, the microscopic smear of the toner pile causes loss of image resolution. A first order understanding of this effect can be obtained by examining what happens to a toner particle during slip transfer, as shown in FIG. 1. In this simple model, the toner particle rolls as a consequence of the velocity difference of the two bodies. Its displacement is equal to one-half of their relative displacements.

It can be seen that the positional slip is directly proportional to length of the effective transfer zone and to the slip velocity ratio—the velocity difference divided by the sum of the velocities. However, it is not a function of the particle radius or of the toner pile height. Thus the slip is represented by the following:

$$D=[(V_1 - V_2)/V_{mean}]W$$

$$S=0.5\ D$$

$$R_p=\text{resolved line pair}=2W[(V_1 - V_2)/V_{mean}]$$

where: $V_1$=velocity of body 1

$V_2$=velocity of body 2

W=width of effective transfer zone $$L=\text{line pair frequency}=V_{mean}/[2(V_1 - V_2)W]$$

The unit typically used to measure spatial resolution is line-pairs per millimeter. The reciprocal of that unit gives the spatial period. The exact correlation between slip and resolvable resolution is not well known, but a commonly chosen criterion is that the amount of slip can not be greater than half of the maximum resolvable line width. Note that the actual resolution depends also on other characteristics of the imaging and development subsystems.

A second problem influenced by transfer slip is called 'dot gain', a term used to describe image pixel magnification which alters the color rendition. For a typical color IOT application, the extant dot gain specification is $\leqq 10$ microns. As an example, with this specification and an assumed effective transfer zone length of 3 mm, the maximum tolerable speed mismatch is 0.333%. This specification has implications on the accuracy of the servo controls and on mechanical tolerances such as the eccentricities of P/R drums.

Due to the dry friction of the belt-drum interaction, a change in the sense of the relative velocity causes a reversal of the interface force and a large disturbance on the motion.

Eccentricities in the photoreceptor drum, the drum servo elements, and uncorrected drum motion disturbances all cause variations of the relative velocity between the photoreceptor drum and intermediate belt. In order to stay within a slip specification of 0.333% and avoid crossover between positive and negative slip, the adopted design criterion could be to set the speed of the photoreceptor drum to be either +0.167% or −0.167% different from that of the belt.

Uncertainties on photoreceptor drum and intermediate belt drive roll diameters require an automatic adjustment of the mean velocity of each photoreceptor drum. A procedure was conceived to achieve this adjustment and is called the bellyrub test.

The bellyrub test consists of slowly slewing the velocity command of each drum through the possible velocity match range while monitoring the current demanded by the drive motor to cope with the changes in drag. The crossing of the exact speed match will be evidenced by a distinct change in amplitude of the motor current.

This test can be performed in the following manner:

1. The average drum surface velocity is repetitively slewed from 0.126 m/sec (4.96 ips) to 0.128 m/sec (5.04 ips) and then back to 0.126 m/sec with a period of 200 seconds.

2. While recording the rotational speed from the shaft-angle encoder, and with the feedback control servo loop active, the current delivered to the motor must be simultaneously recorded.

Figure 2:
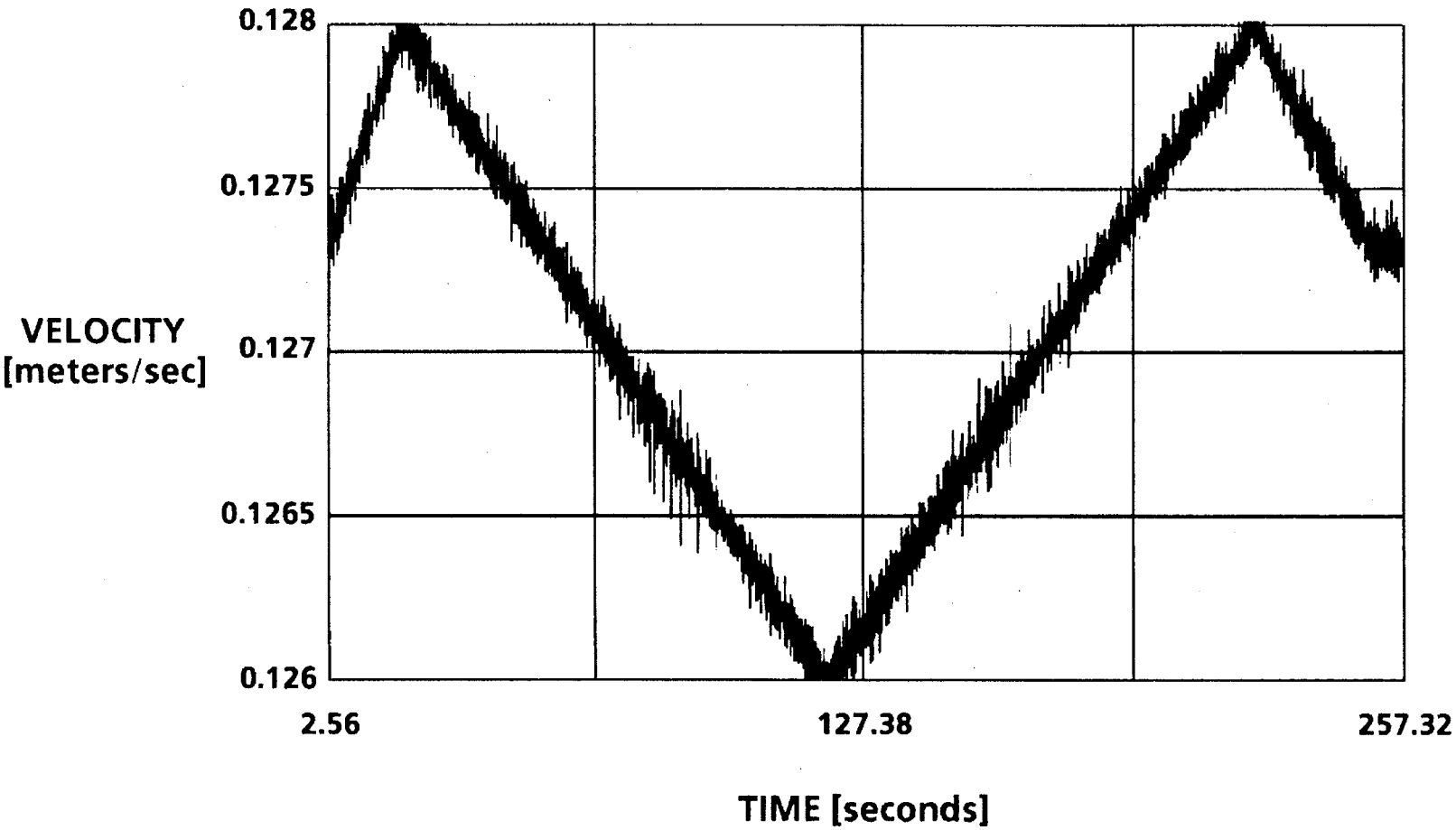
FIG. 2 is a graphical illustration of slews of the photoreceptor surface velocity of alternating increasing and decreasing type.

The measured angular velocity of the drum is shown in FIG. 2 below, and the measured motor current is shown in FIG. 3. The speed and current measurements can be made using dedicated metering devices or can be monitored as an integral functional portion of controller 90.

Note, that the undulations of the motor current are significantly more severe when the surface speed of the drum is approximately equal to the speed of the intermediate belt. This is due to the relative slip between the photoreceptor and the intermediate medium alternating in direction.

The above-described test provides a method for calibrating the drive speed of a photoreceptor The drive speed of a photoreceptor drum must be redetermined each time a new component must be installed into a printing machine. This is due to manufacturing tolerances, which cause the diameters to be different in every photoreceptor drum manufactured. This diameter difference can result in varying relative surface velocities between the surface of the photoreceptor drum and the intermediate transfer of medium. While there is some degree of allowable variation in the surface velocity mismatch, as described above, there must be care taken to ensure that the relative velocity does not change sign, i.e., cross the zero point, or extreme degradation of image quality will result.

If the above-described test is performed each time that a new major component such as a photoreceptor drum is installed in a printing machine, or in the event of another environmental event which could cause the physical dimensions of the components of the machine to be altered, i.e., extreme temperature variations and size alterations due to thermal contraction/expansion, the correct drive speed for each new component and/or changed component can be ascertained and print quality maintained. Once the drive speed for each component is ascertained, the speed can then be maintained by use of an optical or magnetic encoder connected to the component drive which controls a servo motor.

In recapitulation, there is provided a method and apparatus for controlling speed match between a photoreceptor and an intermediate transfer member to prevent image degradation by creating a deliberate speed mismatch. It has been found that slight variations in speed match between a photoreceptor and transfer member will maintain acceptable image quality, however, should the relative velocity between the members change sign, unacceptable image error results. The method herein comprises slewing the velocity of a photoreceptive member over a range of speeds while monitoring the output control signal current of a drive motor. The resulting control signal current has a large oscillation at the velocity at which the speed of the photoreceptor matches that of the intermediate transfer member. A controller is then used to maintain the motor velocity at a speed slightly less than or slightly greater than the intermediate transfer member speed so as to prevent a change in sign of the relative velocity between the two moving surfaces.

It is, therefore, apparent that there has been provided in accordance with the present invention, a speed match control scheme that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A method of controlling the relative velocity between an image bearing member and an image receiving member of a printing machine, comprising:

determining the relative velocity between the image bearing member and the image receiving member; and adjusting the relative speed of the image bearing member and the image receiving member so that there is a velocity mismatch within a preselected range, therebetween.

2. A method according to claim 1, wherein said determining step comprises:

slewing the velocity of the image bearing member over a variable range of allowable drive speeds; and monitoring the current of a motor driving the image bearing member while performing the velocity slewing step.

3. A method according to claim 1, wherein said determining step comprises:

slewing the velocity of the image receiving member over a variable range of allowable drive speeds; and monitoring the current of a motor driving the image receiving member while performing the velocity slewing step.

4. A method according to claim 1, further comprising detecting the amplitude of a motor current signal which corresponds to a velocity match between the image bearing member and the image receiving member and maintaining a mismatch in velocities.

5. A method according to claim 1, wherein said adjusting step comprises setting the velocity mismatch to a preselected range of speeds, wherein said preselected range is selected to maintain an unchanged polarity between the image bearing member and the image receiving member.

6. A method according to claim 5, wherein said adjusting step comprises setting a motor velocity so that the image bearing member operates in a range at a speed slightly greater than but not equal to that of the image receiving member.

7. A method according to claim 6, wherein adjusting step comprises adjusting the relative velocity between the image receiving member and the image bearing member so that the velocity of the image bearing member is about 0.167% greater than the speed of the image receiving member.

8. A method according to claim 5, wherein said adjusting step comprises setting a motor velocity so that the image bearing member operates in a range at a speed slightly less than but not equal to that of the image receiving member.

9. A method according to claim 8, wherein wherein adjusting step comprises adjusting the relative velocity between the image receiving member and the image bearing member so that the velocity of the image bearing member is about 0.167% less than the speed of the image receiving member.

10. A method for maintaining the proper relative velocity between a photoreceptor and an intermediate receiving member in an electrophotographic printing machine, comprising:

determining the relative velocity between the photoreceptor and the intermediate receiving member; and adjusting the speed of the photoreceptor so that there is a slight velocity mismatch between the photoreceptor and the intermediate receiving member.

11. A method according to claim 10, wherein said determining step comprises:

slewing the drive speed of the photoreceptor within a preselected range approximately equal to the velocity of the intermediate receiving member;

monitoring the output current of a motor driving the photoreceptor while the speed slewing step is performed; and setting the drive speed of the photoreceptor to a speed not equal to that of the intermediate receiving member.

12. A method according to claim 11, further comprising detecting the amplitude of the motor current signal which corresponds to the velocity match between the photoreceptor and the intermediate receiving member and maintaining the velocity of the photoreceptor at a speed not equal to the detected equal velocity.

13. A method according to claim 11, wherein said setting step comprises varying the motor velocity so that the photoreceptor moves at a speed slightly greater than but not equal to the intermediate receiving member.

14. A method according to claim 13, wherein said setting step comprises adjusting the relative velocity between the intermediate receiving member and the photoreceptor so that the velocity of the photoreceptor is about 0.167% greater than the speed of the intermediate receiving member.

15. A method according to claim 11, wherein said setting step comprises varying the motor velocity so that the photoreceptor moves at a speed slightly less than but not equal to the intermediate member.

16. A method according to claim 15, wherein said setting step comprises adjusting the relative velocity between the intermediate receiving member and the photoreceptor so that the velocity of the photoreceptor is about 0.167% less than the speed of the intermediate receiving member.

17. A printing machine having an image bearing member and a moving image receiving member, comprising:

a motor for moving the image bearing member;

a controller associated with said motor, for regulating said motor to move the image bearing member at a velocity either slightly greater than or slightly less than a velocity at which the image receiving member moves to maintain a velocity differential between the image bearing member and the moving image receiving member.

18. A printing machine having an image bearing member and a moving image receiving member, comprising:

a motor for moving the image bearing member;

a controller associated with said motor, for regulating said motor to move the image bearing member at a velocity either slightly greater than or slightly less than a velocity at which the image receiving member moves, wherein said controller slews the speed of said motor; and a sensor to monitor a current of said motor while the speed is slewed and to generate a signal indicative thereof, wherein said controller is responsive to the signal generated by said sensor for generating a control signal to set the drive speed of said motor to a speed so that the speed of the image bearing member is not equal to that of the image receiving member.

19. A printing machine according to claim 18 wherein said image bearing member comprises a photoreceptive member.

20. A printing machine according to claim 18 wherein said image receiving member comprises an intermediate transfer member.

21. A printing machine according to claim 18 wherein said image receiving member comprises a copy sheet.

* * * * *